United States Patent [19]

Stewart et al.

[11] Patent Number: 5,018,538

[45] Date of Patent: May 28, 1991

[54] CIGARETTE MAKING MACHINE

[75] Inventors: David B. Stewart, Dundee, Scotland; Godfrey A. Wood, Aylesbury, England

[73] Assignee: Molins PLC, London, England

[21] Appl. No.: 308,513

[22] Filed: Feb. 10, 1989

[30] Foreign Application Priority Data

Feb. 10, 1988 [GB] United Kingdom ..... 8802976

[51] Int. Cl.[5] ..... A24C 5/14; A24C 5/18; A24C 5/39

[52] U.S. Cl. ..... 131/109.1; 131/84.1; 131/109.2; 131/110

[58] Field of Search ..... 131/109.1, 109.2, 108, 131/110, 84.1

[56] References Cited

U.S. PATENT DOCUMENTS 4,223,685 9/1980 Labbe ..... 131/109.1

4,616,663 10/1986 Lorenzen et al. ..... 131/109.1

*Primary Examiner*—V. Millin

*Attorney, Agent, or Firm*—Antonelli, Terry, Stout & Kraus

[57] ABSTRACT

Apparatus for feeding tobacco in or to a cigarette making machine comprises a number of carded rollers (10, 11, 12, 18) which transfer a metered stream of tobacco from one to the other while allowing relatively short strands or particles of tobacco to drop out from the transfer point or points, means (29, 30, 31, 32) for collecting and metering the tobacco shorts, and means (23, 24, 26, 28) for collecting and metering longer particles of tobacco which travel beyond the transfer point or points from which tobacco shorts drop out, the metered streams of tobacco shorts and longer particles being combined to form a cigarette filler stream which is to be enclosed in a continuous wrapper to form a continuous cigarette rod.

12 Claims, 1 Drawing Sheet

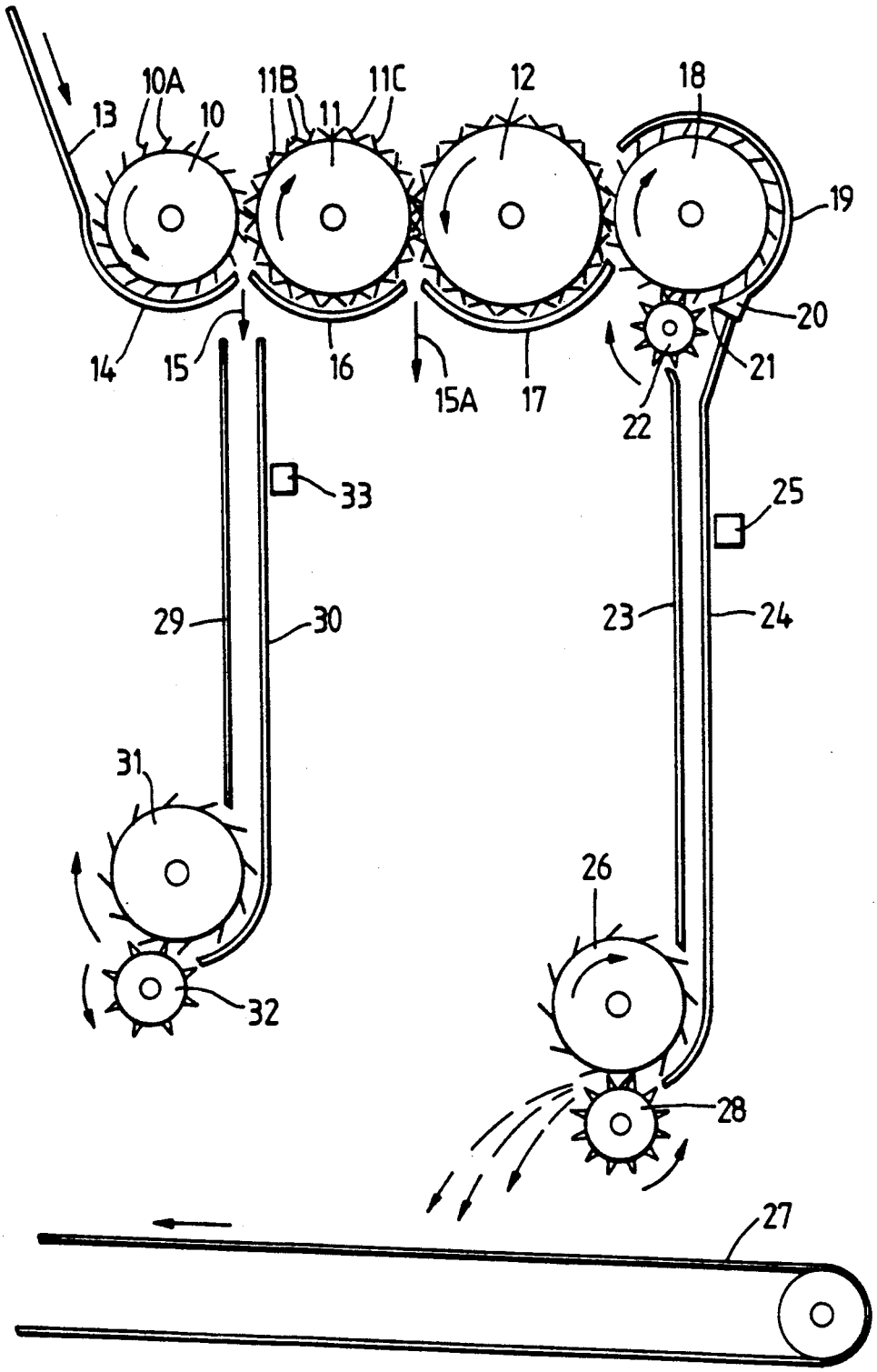
10A
11B
11C
12
18
13
10
11
19
20
14
15
16
15A
17
21
22
33
25
29
30
23
24
31
26
32
28
27

CIGARETTE MAKING MACHINE

This invention is concerned especially with the part of a cigarette making machine commonly referred to as a "hopper"; that is to say, the part which meters tobacco from a storage area in the machine and feeds a substantially loose metered stream of the tobacco particles to a rod-forming part of the machine. However, apparatus according to this invention may be used to prepare the tobacco prior to its delivery into a cigarette making machine as will be described.

According to one aspect of this invention, a tobacco feed apparatus for a cigarette making machine comprises a number of carded rollers (i.e. pin-carrying rollers) which transfer a metered stream of tobacco from one to the other while allowing relatively short strands or particles of tobacco to drop out from the transfer point or points, means for collecting and metering the tobacco shorts, and means for collecting and metering longer particles of tobacco which travel beyond the transfer point or points from which tobacco shorts drop out, the metered streams of tobacco shorts and longer particles being combined to form a cigarette filler stream which is to be enclosed in a continuous wrapper to form a continuous cigarette rod.

The surface speeds of successive carded rollers preferably increase progressively by at least 10%. That is to say, the second roller has a surface speed at least 10% greater than the first roller, and so on. A preferred speed increase is 75%, the ratio between adjacent roller speeds being accordingly 1.75:1. The ratio may be even greater, for example up to 4:1.

The progressively increasing surface speeds of successive rollers, of which there are preferably at least three, not only serves to separate the tobacco strands, while allowing tobacco shorts to drop out mainly between the first and second rollers, but also aligns the longer strands in the direction of movement. After leaving the rollers, the aligned longer strands may be broken into shorter pieces in a controlled manner so as to avoid the occurrence of excessively long strands. Examples of arrangements for breaking the longer strands are described below.

As an alternative, or in addition to the provision of means for breaking up longer strands downstream of the rollers, the speed ratio between at least two of the rollers (for example the last two) may be controllable so as to achieve a degree of long strand breakage if necessary.

Tobacco shorts are preferably collected in a column from which they are metered at the lower end by a carded roller at a variable speed such as to maintain a substantially constant height of tobacco shorts in the column. By collecting and metering the tobacco shorts, a hopper according to this invention avoids excessive accumulations of shorts occurring in concentrated areas of the cigarette rod with a consequent risk, for example, of poor cigarette ends.

In a preferred arrangement, at least an intermediate one of the carded rollers has some pins inclined in one direction with respect to radii and other pins inclined in the opposite sense. Preferably alternate circumferentially extending rows of the pins are inclined in opposite senses. By this means, the forwardly inclined pins ensure that tobacco is removed from the preceding roller while allowing shorter particles to drop out, while the backwardly inclined pins resist to some extent the transfer of tobacco to the next roller and accordingly promote the separation of tobacco strands and the longitudinal alignment of longer strands. For this purpose it is assumed that successive rollers rotate in opposite directions. The pins of each drum pass between the pins of the cooperating drum or drums.

Breakage of undesirably long strands of tobacco may be achieved, for example, by feeding the approximately aligned long tobacco strands from a relatively slow carded roller to a much faster carded roller, each roller having axially extending rows of closely spaced pins (for example 30 pins per inch), the rows being at substantial circumferential intervals, for example in the region of 0.25 to 0.5 inches (6.5 to 13 mm). Another possibility is that the tobacco may be fed along a path at one point of which it is gripped between relatively slow rollers which may be carded or rubber-coated, and immediately afterwards is gripped between similar rollers having a substantially higher surface speed.

According to another aspect of this invention, a carded roller apparatus for separating short particles of stranded material (especially tobacco) from longer particles comprises a first carded roller having forwardly inclined pins, a second carded roller arranged to receive the material from the first drum (apart from relatively short particles which are allowed to drop out at the transfer point) and having alternate circumferentially extending rows of pins inclined in opposite directions, and a third carded roller arranged to receive at least the longest particles of the material from the second roller, the rollers being so arranged that the envelopes of the pins of adjacent rollers overlap; i.e. circumferential rows of pins of each roller pass between rows of pins on the or each cooperating roller.

An example of a hopper according to this invention is shown in the accompanying drawing which is a diagrammatic side view of part of the hopper.

As shown in the drawing, the hopper includes a series of three rollers 10, 11 and 12. Tobacco is fed down a ramp 13 from any suitable metering means towards the periphery of the roller 10. A curved plate 14 helps to retain the tobacco on the roller 10 until a transfer area between the rollers 10 and 11 at which tobacco shorts drop out of the remainder of the tobacco as shown by the arrow 15. The roller 11 rotates in the opposite direction to roller 10 and has a higher surface speed. Also, whereas the roller 10 has rearwardly inclined pins 10A, the roller 11 has alternate circumferentially extending rows of pins 11B and 11C which are inclined in opposite senses, pins 11B being forwardly inclined while pins 11C are rearwardly inclined. Thus the forwardly inclined pins 11B readily remove the tobacco from the roller 10, apart from the tobacco shorts which drop through a gap between the curved plate 14 and a similar curved plate 16 around the bottom of the roller 11. Most of the tobacco received by the roller 11 transfers to the roller 12, but a small quantity of tobacco of intermediate length drops through the gap between the curved plate 16 and a similar curved plate 17 around the roller 12 as shown by the arrow 15A.

The drawing shows the roller 12 having both forwardly and rearwardly inclined pins like the roller 11. As an alternative, the roller 12 may be fitted with only forwardly inclined pins.

Longer strands of tobacco which pass the drop-out points between the rollers 10 to 12 are received by a further carded roller 18 which may have a slightly higher surface speed than the roller 12. A curved plate 19 helps to retain the tobacco on the roller 18 and terminates in a body 20 having a sharp edge 21 across which the long strands of tobacco are pulled sharply so as to be broken by a picker roller 22 which removes the tobacco from the roller 18. The picker roller may rotate, for example, at a speed of 600 r.p.m. or higher.

The action of the picker roller causes at least the longest strands of tobacco to be broken into shorter and more acceptable lengths. A channel formed by substantially vertical walls 23 and 24 receives the tobacco from the roller 18 to form a column of which the height is monitored by a device 25. Tobacco is fed from the column 23, 24 at a set speed by a further carded roller 26 and is spread along a conveyor band 27 by a further picker roller 28. The height of the column of tobacco in the channel 23, 24 as seen by the detector 25 is controlled by controlling the feed rate of tobacco along the ramp 13 by the feed means (not shown) above the ramp.

A second vertical channel formed by walls 29 and 30 receives the tobacco shorts. A carded roller 31 at the bottom end of the channel 29, 30 feeds tobacco shorts from the channel 29, 30 at a variable rate determined by the height of the column of tobacco shorts in the channel as detected by an optical or other monitoring device 33. Thus the height of the column of tobacco shorts is maintained substantially constant. A picker roller 32 helps to remove tobacco from the carded roller 31 and to spread it along the conveyor band 27.

As an alternative, the carded roller 18 may be omitted and the picker roller 22 may instead cooperate with the roller 12 so as to feed tobacco directly into the channel 23, 24.

Any suitable means may be provided for feeding an approximately metered flow of tobacco along the ramp 13 towards the roller 10. For example, the feed means may comprise the components shown in our U.S. Pat. No. 4,330,001 up to and including the elevator band 10 and cooperating roller 19. Alternatively, tobacco may be metered from a relatively wide column by a triple roller arrangement such as that described in U.S. Pat. No. 4,446,876.

Tobacco strands of intermediate lengths dropping through the gap between the plates 16 and 17 may be allowed to fall directly onto the conveyor band 27. Alternatively, it may be conveyed together with the tobacco shorts or with the longer tobacco into the channel 29, 30 or 23, 24.

The amount of relatively short tobacco separated out at the transfers between the rollers may be increased by increasing the gap between the respective rollers or vice versa. One or more of the gaps may be made adjustable for that purpose, for example by adjusting the vertical position of the roller 11.

Apparatus according to this invention preferably forms part of the hopper of a cigarette making machine. Alternatively, it may serve as a separate tobacco feed provision which may serve two or more cigarette making machines, the shorts and longer tobacco (and possibly an intermediate-length tobacco) being conveyed separately by pneumatic or other suitable means into the hopper of the cigarette making machine or machines.

We claim:

1. Apparatus for feeding tobacco in or to a cigarette making machine, comprising: a plurality of carded rollers which transfer a metered stream of tobacco from one carded roller to an adjacent carded roller while allowing tobacco shorts in the form of relatively short strands or particles of tobacco to drop out from the transfer point or points between carded rollers; means for collecting and metering the tobacco shorts; means for collecting and metering longer particles of tobacco which travel beyond the transfer point or points between carded rollers from which tobacco shorts drop out; and means for combining the metered streams of tobacco shorts and longer particles to form a cigarette filler stream which is to be enclosed in a continuous wrapper to form a continuous cigarette rod.

2. Apparatus according to claim 1, in which the surface speed of at least one of the rollers is greater than that of the roller immediately upstream of it.

3. Apparatus according to claim 2, in which the increase in surface speed between rollers is at least 10 percent.

4. Apparatus according to claim 3, in which the increase in surface speed between roller is of the order of 75 percent.

5. Apparatus according to claim 1, in which the speed of at least one of the rollers is adjustable.

6. Apparatus for feeding tobacco in or to a cigarette making machine comprising a number of carded rollers which transfer a metered stream of tobacco from one to the other while allowing relatively short strands or particles of tobacco to drop out from the transfer point or points, means for collecting and metering the tobacco shorts, and means for collecting and metering longer particles of tobacco which travel beyond the transfer point or points from which tobacco shorts drop out, the metered streams of tobacco shorts and longer particles being combined to form a cigarette filler stream which is to be enclosed in a continuous wrapper to form a continuous cigarette rod in which one roller after the first roller has some pins inclined forwards in relation to their direction of movement, and some pins inclined backwards.

7. Apparatus according to claim 6, in which the pins on said one roller lie in circumferentially extending rows, the pins in alternate rows being oppositely inclined.

8. Apparatus according to claim 1, including means for breaking the longest strands of tobacco prior to the combining of the metered streams.

9. A carded roller apparatus for separating short particles of stranded material from longer particles, comprising a first carded roller having forwardly inclined pins, a second carded roller arranged to receive the material from the first roller, apart from relatively short particles which are allowed to drop out at the transfer point, and having alternate circumferentially extending rows of pins inclined in opposite directions, and a third carded roller arranged to receive at least the longest particles of the material from the second roller, the rollers being so arranged that the envelopes of the pins of adjacent rollers overlap.

10. Apparatus according to claim 9, in which adjacent rollers are arranged to rotate in opposite directions.

11. Apparatus according to claim 1, in which at least two adjacent rollers are so arranged that the envelopes of the pins on them overlap.

12. Apparatus according to claim 1, in which adjacent rollers are arranged to rotate in opposite directions.

* * * * *